US007769316B2

(12) United States Patent
Kimura

(10) Patent No.: US 7,769,316 B2
(45) Date of Patent: Aug. 3, 2010

(54) DEVELOPING UNIT AND PROCESS CARTRIDGE FOR REDUCING TONER SCATTERING, AND IMAGE FORMING APPARATUS USING THE SAME

(75) Inventor: Hideki Kimura, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 408 days.

(21) Appl. No.: 11/777,645

(22) Filed: Jul. 13, 2007

(65) Prior Publication Data

US 2008/0013982 A1 Jan. 17, 2008

(30) Foreign Application Priority Data

Jul. 13, 2006 (JP) ..... 2006-192431

(51) Int. Cl.
*G03G 15/08* (2006.01)

(52) U.S. Cl. ..... 399/103; 399/98; 399/284

(58) Field of Classification Search ..... 399/91, 399/98, 103, 105, 274, 284
See application file for complete search history.

(56) References Cited

U.S. PATENT DOCUMENTS

| | | | | |
|---|---|---|---|---|
| 4,792,831 | A * | 12/1988 | Takeda et al. | 399/105 |
| 4,800,411 | A * | 1/1989 | Tanaka et al. | 399/103 |
| 4,973,541 | A * | 11/1990 | Kohri et al. | 430/110.2 |
| 5,328,792 | A * | 7/1994 | Shigemori et al. | 430/110.3 |
| 5,519,472 | A * | 5/1996 | Ojima et al. | 399/274 |
| 6,049,689 | A * | 4/2000 | Ishii et al. | 399/284 |
| 6,826,381 | B2 | 11/2004 | Muramatsu et al. | |
| 7,043,182 | B2 | 5/2006 | Sakai et al. | |
| 7,212,773 | B2 | 5/2007 | Sudo et al | |
| 7,228,093 | B2 | 6/2007 | Sakai et al. | |
| 2005/0031374 | A1 | 2/2005 | Nagashima et al. | |
| 2006/0029435 | A1 | 2/2006 | Kasai et al. | |
| 2006/0275053 | A1 | 12/2006 | Nagashima et al. | |

FOREIGN PATENT DOCUMENTS

| | | |
|---|---|---|
| JP | 05-289545 | 11/1993 |
| JP | 08-062975 | 3/1996 |
| JP | 2000-047482 | 2/2000 |
| JP | 2002-229331 | 8/2002 |
| JP | 2005-084557 | 3/2005 |

OTHER PUBLICATIONS

U.S. Appl. No. 12/188,549, filed Aug. 8, 2008, Hori, et al.

* cited by examiner

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A developing unit for developing a latent image formed on an image carrier includes a developer carrier, a developer regulator, and a sealing member. The developer carrier bears a developer, and is disposed facing the image carrier at a first position. The developer regulator regulates an amount of the developer, and is disposed facing the developer carrier at a second position upstream of the developer carrier in a moving direction thereof relative to the first position. The sealing member comes into contact with the image carrier at a third position upstream of the image carrier in a moving direction thereof relative to the first position. Therefore, gas is prevented from flowing from an outside area of the developing unit into an area defined by the second position to the third position.

19 Claims, 8 Drawing Sheets

DEVELOPING UNIT AND PROCESS CARTRIDGE FOR REDUCING TONER SCATTERING, AND IMAGE FORMING APPARATUS USING THE SAME

CROSS REFERENCE TO RELATED APPLICATIONS

This patent application is based on and claims priority under 35 U.S.C. §119 from Japanese Patent Application No. JP2006-192431 filed on Jul. 13, 2006 in the Japan Patent Office, the entire contents of which are incorporated herein by reference.

BACKGROUND OF THE INVENTION

1. Field of the Invention

Exemplary aspects of the present invention generally relate to a developing unit utilized in a copier, a printer and a facsimile, or an image forming apparatus, for example, a multifunctional machine using electrophotographic method, and more particularly to a developing unit, a process cartridge and an image forming apparatus including the same.

2. Discussion of the Background

According to the related arts, in image forming apparatuses such as a copier, printer and so forth, various techniques have been proposed to prevent a developing agent or a developer stored in the developing unit from scattering out of the developing unit.

Related art developing unit storing a two-component developing agent or a developer containing non-magnetic toner and magnetic carriers have been used. An additive may be added to the two-component developer.

The developing unit may include a developing roller serving as a developer carrier, a doctor blade serving as a developer regulator, an agitation/transportation member and so forth.

Toner is supplied to the developing unit from a toner supply outlet as needed according to an amount of toner consumption in the developing unit.

The supplied toner is mixed and transported along with the developer in the developing unit by the agitation/transportation member. The part of the mixed developer is carried on a developing roller.

The developer carried on the developing roller is regulated at an appropriate amount at an opposing position or a second opposing position relative to a doctor blade.

Subsequently, the toner in the developer adheres to a latent image on a photoreceptor drum which is an image carrier at an opposing position or a first opposing position relative to the photoreceptor drum.

In such a developing unit, in order to prevent the developer in the developing unit from scattering out of the developing unit, a sealing member (i.e., an inlet sealing) is disposed upstream of the photoreceptor drum in a rotating direction thereof relative to the first opposing position, which is, the upstream position in a traveling direction of the photoreceptor drum so that the sealing member or the inlet sealing abuts along the longitudinal direction of the photoreceptor drum.

The sealing member serving as a developer dispersion prevention member and a developer accretion prevention member is formed of a flexible material such as a polyurethane rubber and is held to a holder or a supporting member through a double-sided tape.

The holder, which the sealing member is adhered to, is provided to the doctor blade or another holder holding the doctor blade. The holder is fastened by a screw or a similar structure to the doctor blade or to the holder holding the doctor blade.

The sealing member or the inlet sealing structured in a manner described above, covers the position upstream of an opening of the developing unit at the first opposing position, which is the position upstream of the photoreceptor drum in the rotating direction thereof. Additionally, a portion of the developing roller is exposed from the opening.

Therefore, an air current flowing into the developing unit along with a rotary motion of the photoreceptor drum may be shut. Furthermore, a problem of the developer dispersing out of the developing unit due to an increase of the internal pressure of the developing unit may be prevented, if not reduced.

Additionally, a technology that suctions the air in the developing unit by a pump to reduce the internal pressure of the developing unit has been proposed.

However, the related art developing units described above are not able to adequately prevent the developer from scattering out of the developing unit.

In a high-speed image forming apparatus, the rotation speed of the photoreceptor drum and the developing roller may also become high-speed. Consequently, the air current flowing into the developing unit along with the rotary motion of the photoreceptor drum may increase. The increase in the air current may also increase the chance of the dispersion of the developer occurring.

As shown in FIG. 1, when there is a small gap between the doctor blade 850 and the holder 860, the air may easily flow into the developing unit 800. Consequently, the internal pressure of the developing unit 800 may increase causing the toner or the developer to scatter.

The developer borne on the developing roller 800 may be accumulated. Thus, the accumulated developer indicated by a letter symbol G may come into contact with the surface of the holder or an inlet sealing 870. Consequently, a negative pressure may be generated in the area sealed by the developer G. As a result, the internal pressure of the developing unit increases, causing the toner or the developer to scatter.

Another related art technology that suctions the air in the developing unit by a pump to reduce the internal pressure is reduced may be expected to prevent or reduce the dispersion of the developer out of the developing unit. However, since the pump is not designed specifically to eliminate the factors that cause the increase in internal pressure of the developing unit (i.e., the internal pressure of the developing unit increases due to an enhancement of the speed of the image forming apparatus), the size of the pump needs to be increased so that the suction increases accordingly.

SUMMARY OF THE INVENTION

In view of the foregoing, exemplary embodiments of the present invention provide an image forming apparatus which may at least includes a developing unit with a process cartridge.

The developing unit for developing a latent image formed on an image carrier includes a developer carrier, a developer regulator, and a sealing member.

In an exemplary embodiment, the developer carrier bears a developer, and is disposed facing the image carrier at a first position. The developer regulator is configured to regulate an amount of the developer, and is disposed facing the developer carrier at a second position upstream of the developer carrier in a moving direction thereof relative to the first position. The sealing member comes into contact with the image carrier at a third position upstream of the image carrier in a moving direction thereof relative to the first position.

Accordingly gas is prevented from flowing from an outside area of the developing unit into an area defined by the second position to the third position.

In an exemplary embodiment, the developing unit includes a holder configured to hold the sealing member and is tightly attached to the developer regulator.

In an exemplary embodiment, the developing unit includes the holder tightly attached to the developer regulator through an adhesive member.

In an exemplary embodiment, the adhesive member is a double-faced tape or an adhesive material.

In an exemplary embodiment, the holder is tightly attached to the developer regulator through an elastic material.

In an exemplary embodiment, the elastic material is a urethane foam or a foamed rubber.

In an exemplary embodiment, the holder is integrally formed with the developer regulator.

In an exemplary embodiment, the sealing member is integrally formed with the developer regulator.

In an exemplary embodiment, the developing unit includes a vent path from an inside of the developing unit to an area from the second position to the third position.

In an exemplary embodiment, the sealing member has a U-shaped curve in contact with the image carrier.

In an exemplary embodiment, the developer consists of a toner, a carrier, and satisfies the following relationship:

$$3 \leqq Dv \leqq 8, \text{ and}$$

$$1.00 \leqq Dv/Dn \leqq 1.40,$$

wherein Dv (μm) is a volume-average particle diameter of the toner, and Dn (μm) is a number average particle diameter thereof.

In an exemplary embodiment, the toner has a shape factor (SF-1) in a range between 100 and 180, and a shape factor (SF-2) in a range between 100 and 180.

Exemplary embodiments provide a process cartridge detachable relative to an image forming apparatus.

In an exemplary embodiment, the process cartridge includes an image carrier, at least one charging unit, the above described developing unit and a cleaning unit. The charging unit is configured to charge the image carrier. The cleaning unit is configured to clean the image carrier.

An exemplary embodiment provides an image forming apparatus including an image carrier, a charging unit, an exposure unit, the above described developing unit, a transfer unit, and a fixing unit.

In an exemplary embodiment, the charging unit is configured to charge the image carrier. The exposure unit is configured to irradiate the image carrier with an exposure light to form a latent image thereon. The transfer unit is configured to transfer the toner image onto a transfer sheet. The fixing unit is configured to fix the toner image on the transfer sheet.

Additional features and advantages of the present invention will be more fully apparent from the following detailed description of exemplary embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
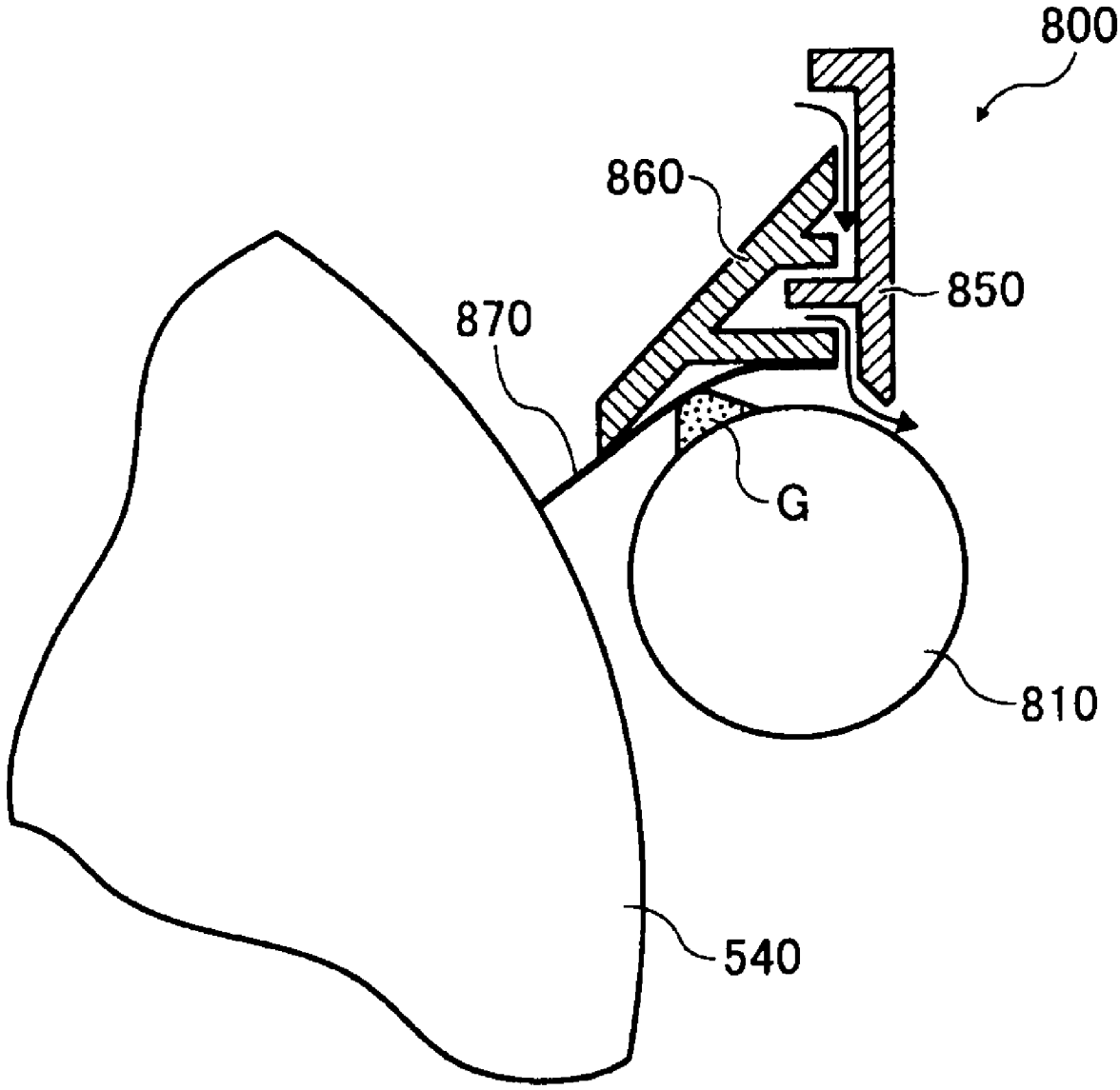
FIG. 1 Prior Art
FIG. 1 is an enlarged view of a portion of a developing unit according to a related art developing unit.

It is understood that if an element or layer is referred to as being "on," "against," "connected to," or "coupled to" another element or layer, then it can be directly on, against connected or coupled to the other element or layer, or intervening elements or layers may be present.

In contrast, if an element is referred to as being "directly on," "directly connected to," or "directly coupled to" another element or layer, then there are no intervening elements or layers present. Like numbers refer to like elements throughout the figures. As used herein, the term "and/or" includes any and all combinations of one or more of the associated listed items.

Spatially relative terms, such as "beneath," "below," "lower," "above," "upper," and the like, may be used herein for ease of description to describe an element or an element's feature or relationship to another element(s) or feature(s) as illustrated in the figures.

It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below.

The device may be otherwise oriented at various angles (i.e. rotated 90 degrees or at other orientations), and the spatially relative descriptors used herein are interpreted accordingly.

Although the terms first, second, etc. may be used herein to describe various elements, components, regions, layers, and/ or sections, it is understood that these elements, components, regions, layers, and/or sections are not limited by these terms.

These terms are used to distinguish one element, component, region, layer, or section from another element, component, region, layer, or section. Thus, a first element, component, region, layer, or section discussed below could be termed a second element, component, region, layer, or section without departing from the teachings of the present invention.

The terminology used herein is for the purpose of describing particular embodiments and is not intended to limit the present invention. As used herein, the singular forms "a", "an," and "the" are intended to include the plural forms as well, unless the context clearly indicates otherwise.

It is further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for clarity. However, the disclosure of this patent specification is not limited to the specific terminology so selected and it is understood that each specific element includes all technical equivalents that operate in a similar manner.

Exemplary embodiments of the present invention are now explained below with reference to the accompanying drawings.

In a later described example, exemplary embodiment, or alternative example, for simplicity of the drawings and the descriptions, the same reference numerals are given to the constituent elements such as parts and materials having the same functions, and the descriptions thereof will be omitted unless otherwise stated.

Typically, but not necessarily, references to paper refer to a medium on which an image is formed. Other printable media are available in the form of sheets and their use here is included. For simplicity, this Detailed Description section refers to paper, sheets thereof, paper feeder, etc. It is understood, however, that the sheets, etc., are not limited only to paper.

Figure 2:
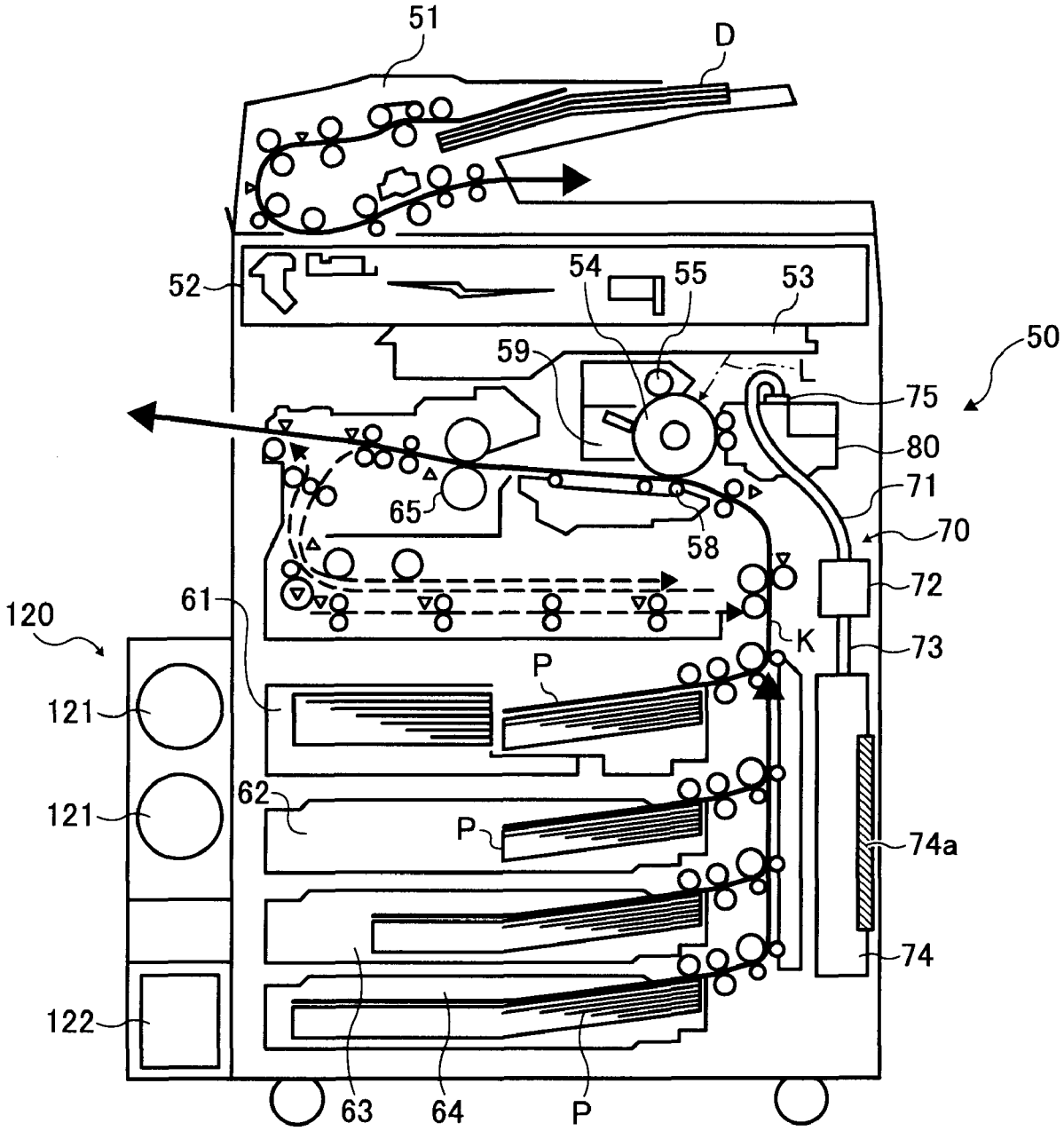
FIG. 2 is a schematic diagram illustrating an image forming apparatus according to a first exemplary embodiment of the present invention.

Referring now to the drawings, wherein like reference numerals designate identical or corresponding parts throughout the several views, particularly to FIG. 2, a structure and a function of an image forming apparatus according to a first exemplary embodiment of the present invention is described.

With reference to FIGS. 2 through 6, a detailed description is given of the first exemplary embodiment of the present invention.

A process cartridge herein refers to a unit detachable from the image forming apparatus, and in one embodiment, includes at least a charging unit configured to charge an image carrier, a developing unit configured to develop a latent image formed on the image carrier, and a cleaning unit configured to clean a surface of the image carrier.

In one embodiment, the image carrier is integrally formed with at least one of the above units.

First, with reference to FIG. 2, a description is given of the structure and the operation of a digital copier, which is an image forming apparatus according to the first exemplary embodiment.

In FIG. 2, a digital copier 50 serving as an image forming apparatus includes at least a document transportation unit 51, a document reading unit 52, an exposure unit 53, a photoreceptor drum 54 serving as an image carrier, a charging unit 55, a transfer unit 58, a cleaning unit 59, sheet feed cassettes 61 through 64, a fixing unit 65, an air intake unit 70, a developing unit 80, a toner bank 120 and a waste toner bottle 122.

According to one embodiment of the present invention, the document transportation unit 51 transports the document D to the document reading unit 52. The document reading unit 52 optically reads an image information of the document D. The exposure unit 53 irradiates the photoreceptor drum 54 with an exposure light L based on the image information read by the document reading unit 52.

The charging unit 55 charges the photoreceptor 54. The transfer unit 58 transfers a toner image formed on the photoreceptor drum 54 to a recording medium P. The cleaning unit 59 recovers untransfered toner on the photoreceptor drum 54.

The sheet feed cassettes 61 through 64 store the recording medium P, for example, transfer paper or any other desired recording medium. The fixing unit 65 fixes the unfixed toner on the recording medium P. The air intake unit 70 draws the air out of the developing unit 80. The developing unit 80 develops an electrostatic latent image formed on the photoreceptor drum 54.

The toner bank 120 includes a plurality of toner bottles 121. The waste toner bottle 122 stores the waste toner recovered by the cleaning unit 59 and the transfer unit 58.

With reference to FIG. 2, a description is given of an exemplary operation of the image forming apparatus 50 at the time of image formation according to a first exemplary embodiment.

First, the document D is transported in a direction shown by an arrow by conveyance rollers of the document transportation unit 51 and passes over the document reading unit 52. When passing over the document reading unit 52, the image information on the document D is optically read.

The image information optically read by the document reading unit 52 is converted into an electric signal. Subsequently, the image information converted into the electric signal is transmitted to the exposure unit 53 serving as a writing unit.

The exposure unit 53 emits an exposure light L, for example, a laser beam, based on the electric signal of the image information onto the photoreceptor drum 54. The photoreceptor drum 54 rotates in a clockwise direction in FIG. 2. The surface of the photoreceptor drum is evenly charged at a position opposite to the charging unit 55.

Subsequently, the surface of the photoreceptor drum 54, charged at the charging unit 55, arrives at the position where the exposure light L is emitted. At this position, the electrostatic latent image according to the image information of the document D is formed.

Subsequently, the surface of the photoreceptor drum 54 arrives at a position opposite to the developing unit 80. Therefore, the latent image on the photoreceptor drum 54 is developed by the developing unit 80.

The toner in the developing unit 80 is mixed with the toner supplied from the toner supply unit and carriers by a puddle roller or any other desired structure. The toner charged by friction is supplied on the developing roller.

The toner in the toner supply unit is supplied to the developing unit 80 as necessary when the toner in the developing unit 80 is consumed. The toner consumption in the developing unit 80 is detected by a toner density sensor disposed in the developing unit 80.

Furthermore, the toner in the toner supply unit is supplied as necessary from the toner bank 120. The toner bank 120 includes a plurality of detachable toner bottles 121. Subsequently, the surface of the photoreceptor drum 54 developed by the developing unit 80 arrives at a position opposite to the transfer unit 58.

The toner image on the photoreceptor drum 54 is transferred on the recording medium P at this position. The untransfered toner which has not been transferred on the recording medium may remain on the photoreceptor drum 54.

The surface of the photoreceptor drum 54 having the untransfered toner, which has passed the transfer unit 58, arrives at a position opposite to the cleaning unit 59. Subsequently, the untransfered toner is collected to the cleaning unit 59 by the cleaning blade, which comes into contact with the photoreceptor drum 54.

The toner recovered in the cleaning unit 59 is transported as waste toner to the waste toner bottle 122 by way of a waste toner transportation path (not shown). After passing the cleaning unit 59, the surface of the photoreceptor drum 54 comes to a neutralization unit (not shown). Therefore, the potential of the surface of the photoreceptor drum 54 is diselectrified by a neutralization device (not shown), and then a sequence of the image forming processes is finished.

The recording medium P transported to the transfer unit 58 is subjected to following processes.

One of the sheet feed cassettes 61 through 64 is automatically or manually selected. For example, the sheet feed cassette 61 on the top shelf is selected. One sheet of the recording medium P stored in the sheet feed cassette 61 is transported to a conveyance path K. After passing the conveyance path K, the recording medium P, which passes the conveyance path K, comes to a resist roller.

When the recording medium P arrives at the resist roller, the recording medium P is transported to the transfer position, which is a position between the transfer unit 58 and the photoreceptor drum 54 at a timing corresponding to the position of the toner image formed on the photoreceptor drum 54. After passing the transfer unit 58, the recording medium P, on which the transfer process is performed, arrives at the fixing unit 65. Accordingly, the unfixed toner image on the recording medium is fixed by heat and pressure. Subsequently, the recording medium P is ejected out of the image forming apparatus 50 as an image output after the fixing processing is performed. Subsequently, a sequence of the image formation is finished.

The image forming apparatus according to the first exemplary embodiment is high-speed, and the transportation speed for the recording medium P, which is a linear velocity of a circumferential surface of the photoreceptor drum 54, is set to approximately 630 mm/sec.

As shown in FIG. 2, according to one embodiment of the present invention, the air intake unit 70 includes at least a duct 75, an air intake tube 71, an air pump 72, which is a diaphragm air pump, an exhaust tube 73, and a recovery tank 74.

The duct 75 is attachable and detachable to and from an opening of the developing unit 80 such that the duct 75 communicates with an inside of the developing unit 80. The air intake tube 71 is formed of a flexible material. The air intake tube 71 transports the air drawn from the duct 75 to the air pump 72. When the air is drawn from the duct 75, the toner flowing in the developing unit 80 is also drawn. The air pump 72 includes a pump main body having an air intake valve and an air exhaust valve, a rubber member covering a depressed portion of the pump main body, and a driving unit driving the rubber member so as to change the inner volume of the pump main body.

The exhaust tube 73 is formed of a flexible material. The exhaust tube 73 transports the air exhausted from the air pump 72 to the recovery tank 74. When the air is exhausted from the air pump 72, the toner may also be exhausted.

The recovery tank 74 is disposed in the vicinity of the sheet feed cassettes 61 through 64 and is attachable to and detachable from relative to the image forming apparatus 50. The recovery tank 74 includes an opening which communicates with the image forming apparatus 50.

A filter 74*a* is provided to the opening of the recovery tank 74 to cover the opening. The filter 74*a* is formed in a manner such that polytetrafluoroethylene (PTFE) is stretched. The filter 74*a* has a continuous porous structure and collects the toner through air.

While the above image forming process is performed, the air intake unit 70, as described above, draws the air out of the developing unit 80 using the air pump 72. Therefore, a rise of the internal pressure of the developing unit 80 may be suppressed, if not reduced.

Figure 3:
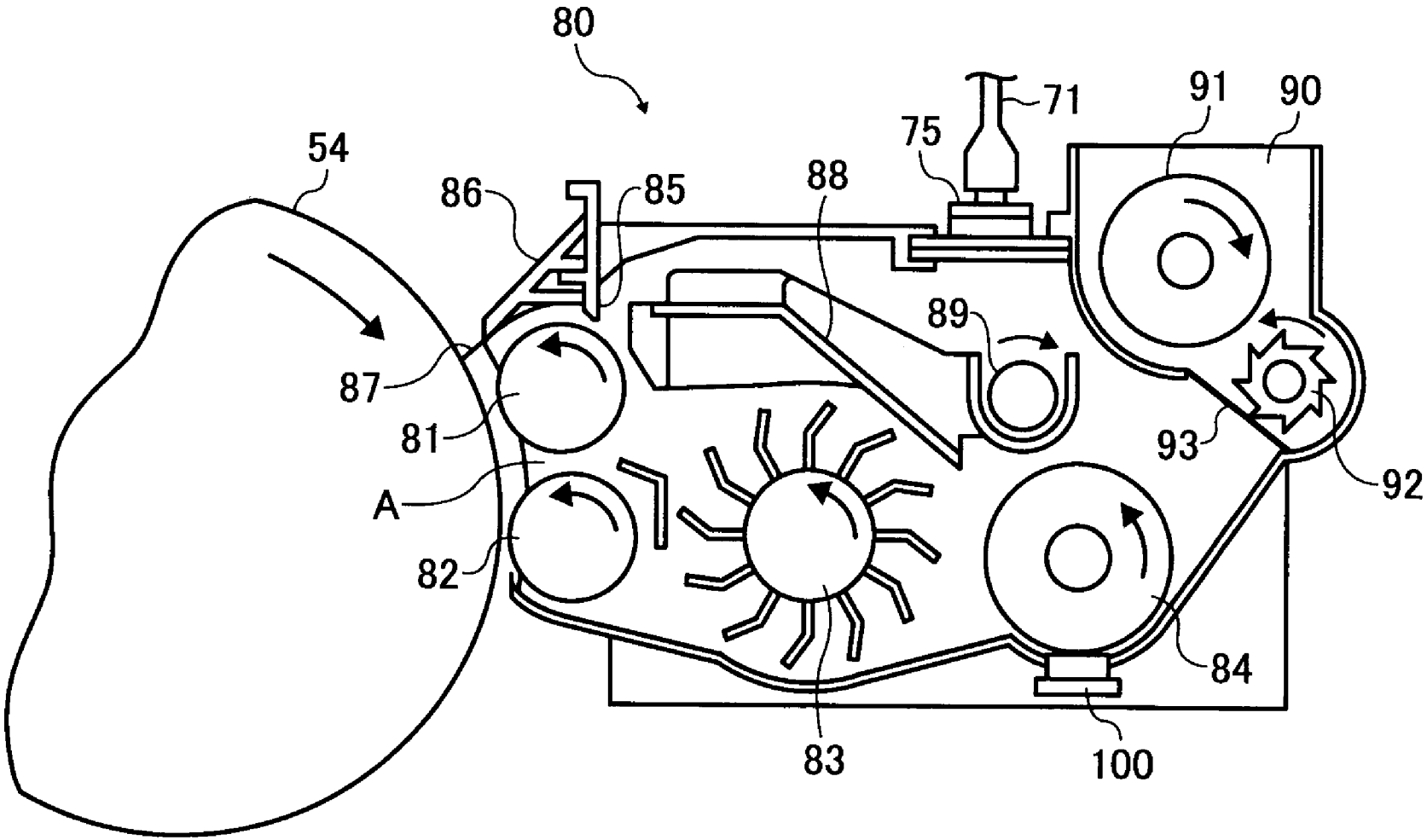
FIG. 3 is a cross-sectional view illustrating a developing unit of the image forming apparatus of FIG. 2.

Furthermore, an air current flowing out of the developing unit 80 may be suppressed, if not reduced, at an opening A provided with the developing rollers 81 and 82 of the developing unit 80, shown in FIG. 3, facing the photoreceptor drum 54, shown in FIG. 2, in the developing unit 80. Accordingly, scattering of toner or scattering of the developer from the opening A may be reduced.

The air drawn out of the developing unit 80 through the duct 75 is transported to the recovery tank 74 by way of the air intake tube 71, the air pump 72 and the exhaust tube 73. The toner flowing with air in the developing unit 80 is transported to the recovery tank 74.

Subsequently, the air transported to the recovery tank 74 is ejected out of the image forming apparatus 50. The toner transported to the recovery tank 74 is collected by the filter 74*a* and stored in the recovery tank 74.

Referring now to FIG. 3, a detailed description will be given of the developing unit 80.

According to an embodiment of the present invention, the developing unit 80 includes a first developing roller 81, a second developing roller 82, a paddle roller 83, an agitation roller 84, a doctor blade 85, a holder 86, an inlet sealing 87, an agitation plate 88, a transportation screw 89, a toner density sensor or a magnetic sensor 100, and an opening A exposing the first developing roller 81 and the second developing roller 82.

In the developing unit 80, a developer, for example, a two-component developer having carriers (i.e., magnetic carriers) as a magnetic material and toner (i.e., nonmagnetic toner) is stored.

The first developing roller 81 serves as a developer carrier facing the photoreceptor drum 54. The second developing roller 82 serves as a developer carrier facing the photoreceptor drum 54. The paddle roller 83 supplies the developer to the first developing roller 81. The agitation roller 84 includes a plurality of elliptic plates 84*a* in a rotary shaft direction or a longitudinal direction. The doctor blade 85 is disposed in a manner such that the tip portion thereof faces the first developing roller 81. The holder 86 serves as a holding member to hold the inlet sealing 87.

The inlet sealing 87 serves as a sealing member, which is disposed in a projecting manner toward the photoreceptor drum 54, and abuts the photoreceptor drum 54. The agitation plate 88 agitates the developer in a longitudinal direction. The transportation screw 89 agitates the developer in a longitudinal direction. The toner density sensor or the magnetic sensor 100 detects the toner density of the developer stored in the developing unit 80.

The developing rollers 81 and 82 rotate in a direction shown by an arrow in FIG. 3. The developer is evenly agitated and mixed in the rotary shaft direction or the longitudinal direction by the agitation roller 84, the transportation screw 89, and the agitation plate 88, each rotating in the direction indicated by the arrow, respectively.

The friction-charged toner adheres to the carriers and is supplied to the first developing roller 81 along with the carriers by the paddle roller 83 serving as a supply member. Subsequently, the developer is carried on the first developing roller 81. Subsequently, the developer is carried on the first developing roller 81.

The toner stored in the toner supply unit 90 is transported by a transportation member 91 to a supply roller 92 having a sawtooth roller. Accordingly, the toner is supplied from the supply roller 92 to the developing unit 80 through a plurality of holes formed in a slit plate 93 as necessary. The toner in the toner supply unit 90 is supplied to the developing unit 80 as necessary based on the detection result detected by the toner density sensor 100, which detects the toner density in the developing unit 80.

The toner density herein refers to the ratio of the toner in the developer. The toner density sensor 100 is a magnetic sensor that detects the magnetic permeability of the developer flowing in the vicinity of a detection surface of the toner density sensor 100.

In a case where the toner density of the developer is relatively low, the sensor output or the output voltage of the toner density sensor 100 increases as the magnetic permeability increases. In a case where the toner density of the developer is relatively high, the sensor output or the output voltage of the toner density sensor 100 decreases as the magnetic permeability decreases.

After the amount of the developer carried by the first developing roller 81 is regulated at a position opposite to the doctor blade 85, which is the second opposing position, the developer reaches at a position opposite to the photoreceptor drum 54, which is at the first opposing position serving as the first developing region.

Furthermore, the developer, after passing the opposing position, travels from the first developing roller 81 to the second developing roller 82. Subsequently, the developer reaches at a position opposite to the photoreceptor drum 54, which is the second developing region.

The toner in the developer adheres to the electrostatic latent image formed on the surface of the photoreceptor drum 54 at the first and second opposing regions. Accordingly, the developing process performed by the developing unit 80 is completed.

After the developing process, the developer on the second developing roller 82 separates from the second developing roller 82. Subsequently, the developer is transported to the position of the agitation roller 84 by the paddle roller 83.

The developer separated from the first developing roller 81 at the position of the doctor blade 85 is agitated in the longitudinal direction by the agitation plate 88 and the transportation screw 89. Subsequently, the developer is transported to the agitation roller 84.

According to the first exemplary embodiment, the toner used in the developing unit 80 is composed of a toner satisfying the following relationship:

$$3 \leqq Dv \leqq 8 \quad (1)$$

$$1.00 \leqq Dv/Dn \leqq 1.40 \quad (2).$$

Dv (μm) is a volume average particle diameter, and Dn (μm) is a number average particle diameter.

The volume average particle diameter (Dv) is defined by the following formula:

$$Dv=[(\Sigma(nD^3)/\Sigma n)]^{1/3},$$

where n represents the number of the toner particles, and D represents the particle diameter.

The number average particle diameter (Dn) is defined by the following formula:

$$Dn=\Sigma(nD)/\Sigma n.$$

Accordingly, the toner particle that is suitable for the image pattern at the developing process is selected so that a quality image is obtained. In addition, even though the toner is agitated in the developing unit for an extended period of time, a favorable developability is maintained.

In one embodiment, the volume average particle diameter and the number average particle diameter is measured by using a Coulter counter, for example, the Coulter counter TA-2 or Coulter Multisizer, each manufactured by Coulter Co. and measuring size and volume distributions of particles in the toner.

Furthermore, according to the first exemplary embodiment, the toner used in the developing unit 80 is a substantially spherical toner having a shape factor SF-1 within a range between 100 and 180, and a shape factor SF-2 within a range between 100 and 180. Therefore, a stable image density is achieved, and a high transfer efficiency is maintained while suppressing the deterioration of cleanability.

The shape factor SF1 indicates a spherical shape of the toner particle, and is represented by the following equation:

$$SF1=(M^2/S)\times(100\cdot\pi)/4.$$

According to this equation, M is a largest particle diameter of a toner particle in a projection plane among irregular particle diameters. S is a projected area of the toner particle. Therefore, when the toner particle has the shape factor SF-1 equal to 100, the toner particle is perfectly circular. As the shape factor SF-1 increases beyond 100, the spherical shape of the toner is reduced.

The shape factor SF-2 indicates a surface roughness of the toner particle and is represented by the following equation:

$$SF2=(N^2/S)\times(100/(4\cdot\pi)).$$

According to this equation, N is a periphery of a toner particle in a projection plane. S is a projected area of the toner particle. Therefore, when the toner particle has the shape factor SF-2 equal to 100, the surface roughness of the toner particle is insignificant. However, when the shape factor SF-2 increases beyond 100, the roughness increases.

According to one embodiment of the present invention, the shape factors SF-1 and SF-2 are obtained by analyzing the image photographs of the toner particle. The photographs are taken by a scan-type electron microscope, such as the S800 manufactured by Hitachi SEISAKUSHO, and analyzed using an image analyzer, such as the LUSEX3 manufactured by NIRECO Co., Ltd.

Figure 4:
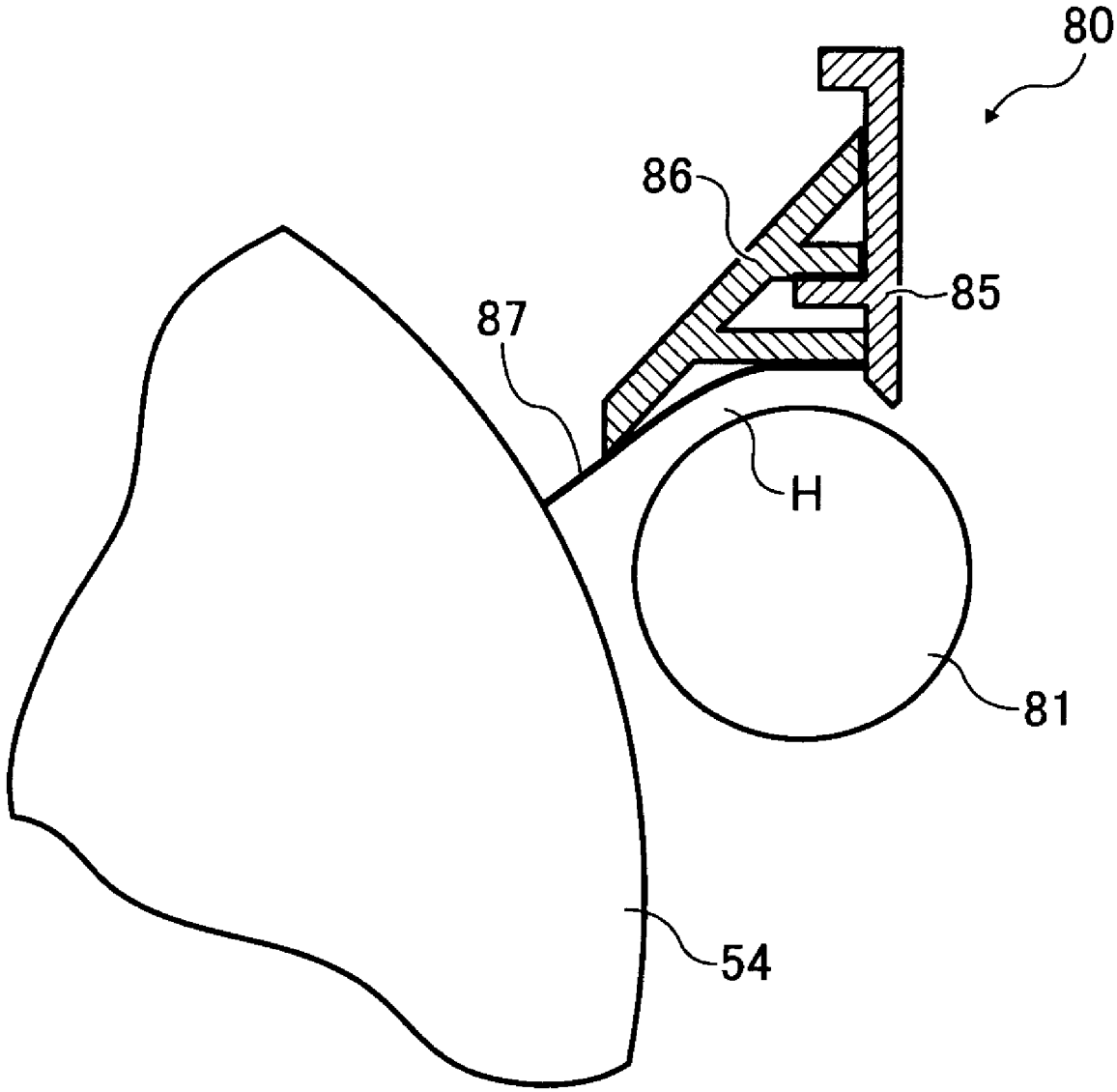
FIG. 4 is an enlarged view of a portion of the developing unit of FIG. 3.

Referring now to FIG. 4, a description is given of a structure and an operation of the developing unit 80 according to the first exemplary embodiment.

FIG. 4 is an enlarged view illustrating an area near the doctor blade 85 and the inlet sealing 87 in the developing unit 80. As illustrated in FIG. 4, in an embodiment of the present invention, the doctor blade 85, serving as the developer regulator, faces the second opposing position of the first developing roller 81 serving as the developer carrier.

Between the doctor blade 85 and the first developing roller 81, there is provided a predetermined gap, which is referred to as a doctor gap.

The second opposing position is provided at a position upstream of the first developing roller 81 in the rotary direction or the traveling direction relative to the first positing position, which is the position at which the first developing roller 81 faces the photoreceptor drum 54.

The doctor blade 85 is formed of a plate member made of a stainless steel, aluminum, or any other suitable material. The tip portion of the inlet sealing 87 serving, as a sealing member, is in contact with the photoreceptor drum 54 along the longitudinal direction, which is the vertical direction in FIG. 4.

The contact position is located at the position upstream of the photoreceptor drum 54 in the rotary direction or the traveling direction relative to the first opposing position.

The inlet sealing 87 is formed of a flexible material such as a polyurethane rubber, Myler, or any other suitable material. The other end of the inlet sealing 87 is adhered by means of a double-sided tape to the surface of the holder 86, the surface facing the developing roller 81. Therefore, the holder 86 acts as a cantilever holding inlet sealing 87.

The holder 86, holding the inlet sealing 87, is held together with the doctor blade 85 by a housing of the developing unit 80 (not shown) in a state where the holder 86 is in contact with the doctor blade 85. The holder 86 is formed of a resin material, a metal material, or any other suitable material. The holder 86 and the doctor blade 85 are fixed by a screw fastening, snap fastening, or any other desired configuration.

The developing unit 80 of the first exemplary embodiment is structured such that the air is prevented from flowing into a region H. The region H refers to an area from the second opposing position to the contact position, as shown in FIG. 4. The second opposing position refers to the position where the doctor blade 85 faces the first developing roller 81. The contact position refers to the position where the inlet sealing 87 abuts the photoreceptor drum 54.

The holder 86 is closely in contact with the doctor blade 85 to prevent a gap from forming therebetween. When the surface roughness of the contact surfaces of both the doctor blade 85 and the holder 86 is low, the doctor blade 85 and the holder 86 are closely in contact with each other.

In an alternative embodiment, the doctor blade 85 and the holder 86 are firmly fit together so that the doctor blade 85 and the holder 86 are closely in contact with each other.

Furthermore, to prevent a gap between the contact surfaces of the doctor blade 85 and the holder 86 due to curling of the doctor blade 85 or the holder 86, a straightening process is performed when manufacturing the doctor blade 85 and the holder 86. In another embodiment, a filler is filled between the contact surfaces of the doctor blade 85 or the holder 86 after assembling the doctor blade 85 and the holder 86.

Referring back to FIG. 1, there is shown a state in which there is a gap between the contact surfaces of the doctor blade 850 and the holder 860, according to a related art structure.

As shown in FIG. 1, when there is a small gap between the doctor blade 850 and the holder 860, the air may easily flow into the developing unit 800 as indicated by an arrow in FIG. 1. Consequently, when the internal pressure in the developing unit 800 increases, the toner or the developer may scatter.

In a region H, shown in FIG. 4, from the second opposing position to the contact position, the developer G may be accumulated so that the developer G comes into contact with the surface of the holder 860 or the inlet sealing 870. Consequently, a negative pressure may be generated in the region H sealed by the developer G. This phenomenon is called a pumping phenomenon. As a result, the internal pressure of the developing unit 800 increases, causing the toner or the developer to scatter.

Figure 5:
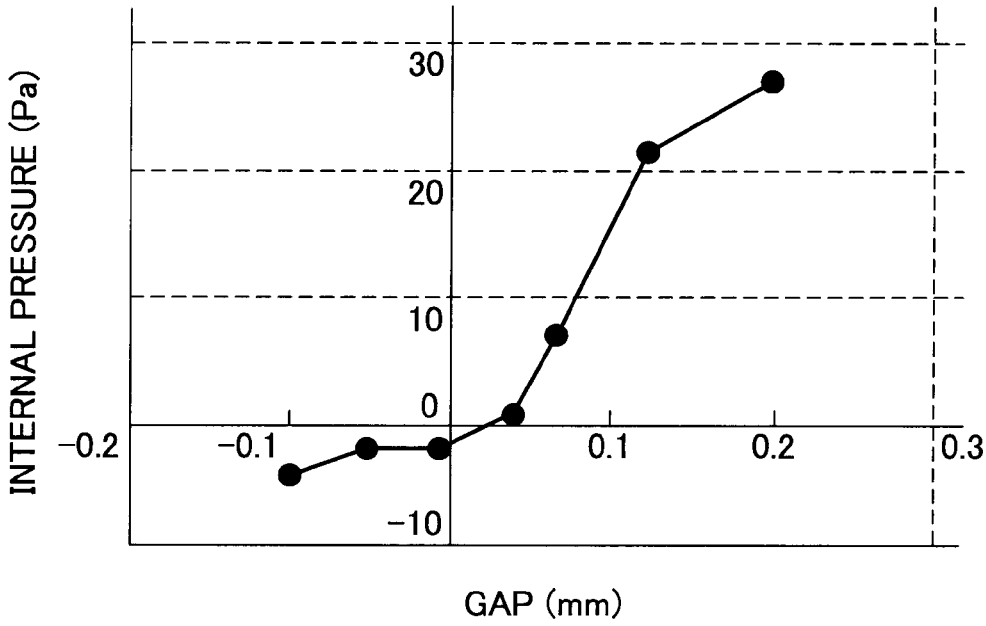
FIG. 5 is a graph illustrating a relationship between a gap between a doctor blade and a holder, and an internal pressure of the developing unit.

Referring now to FIG. 5, a graphical representation of the relationship between the gap between the doctor blade 85 and the holder 86, and the internal pressure of the developing unit 80 is illustrated.

With reference to FIG. 5, the present inventors performed an experiment to measure the internal pressure of the developing unit 80 through the duct 75 using the developing unit 80 of the first exemplary embodiment. The gap between the doctor blade 85 and the holder 86 was varied.

As is illustrated in FIG. 5, when the gap between the doctor blade 85 and the holder 86 increases, the internal pressure of the developing unit 80 increases. However, when there is no gap between the doctor blade 85 and the holder 86, the internal pressure of the developing unit 80 does not increase.

Furthermore, when the gap between the doctor blade 85 and the holder 86 indicates a negative value, the doctor blade 85 and the holder 86 are in a state where the doctor blade 85 and the holder 86 are firmly fitted.

Figure 6:
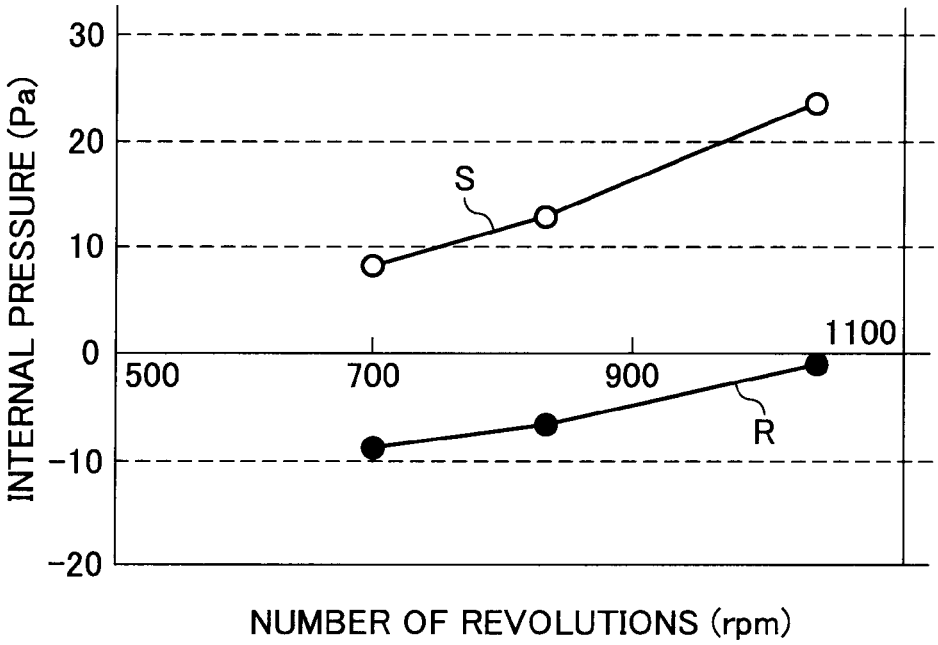
FIG. 6 is a graph illustrating a relationship between the number of revolutions of a developing roller and the internal pressure of the developing unit.

Referring now to FIG. 6, a graphical representation of the relationship between the number of revolutions of the developing roller 81 and the internal pressure of the developing unit 80 is illustrated.

In FIG. 6, the graph R indicates the result of the measurement in which the internal pressure of the developing unit 80 was measured using the developing unit 80 of the first exemplary embodiment having no gap between the doctor blade 85 and the holder 86, while varying the number of revolutions of the developing roller 81.

The graph S in FIG. 6 indicates the result of the measurement in which the internal pressure of the developing unit 80 was measured when there is a gap of 0.5 mm between the doctor blade 85 and the holder 86, while varying the number of revolutions of the developing roller 81.

As is illustrated FIG. 6, when the number of revolutions of the developing roller 81 increases, the internal pressure of the developing unit 80 increases. However, when there is no gap between the doctor blade 85 and the holder 86 as seen in the first exemplary embodiment, it is possible to maintain the internal pressure of the developing unit 80 at a pressure below zero.

Accordingly, the problem of the developer in the developing unit 80 scattering or ejecting out of the developing unit may be prevented.

The present inventors confirmed from these experiments that when compared with the developing unit according to the graph S, the amount of the scattered toner is reduced by 85% to 90% in the developing unit according to the graph R.

According to the first exemplary embodiment, the doctor blade 85 and the holder 86 are separate parts. However, in an alternative embodiment, the doctor blade 85 and the holder 86 are integrally formed by a press-molding using an aluminum material.

The inlet sealing 87 is integrally provided to the holder 86. However, in an alternative embodiment, the inlet sealing 87 is integrally provided to the doctor blade 85.

In these alternative configurations, the air may be prevented from flowing into the region H from the developing unit 80. Accordingly, a similar, if not the same, effect as that of the first exemplary embodiment may be achieved.

As described above, according to the first exemplary embodiment, the developing unit 80 is structured such that the air may be prevented from flowing into the region H. The region H refers to an area from the second opposing position to the contact position. The second opposing position refers to the position where the doctor blade 85 faces the first developing roller 81. The contact position refers to the position where the inlet sealing 87 abuts the photoreceptor drum 54.

Accordingly, an increase in the internal pressure of the developing unit 80 may effectively be reduced with a relatively simple structure. Furthermore, the problem of the developer scattering out of the developing unit 80 may be suppressed.

It should be noted that according to the first exemplary embodiment, the developing unit 80 is independently attached to and detached from the main body of the digital copier 50. However, in an alternative embodiment, the developing unit 80, the photoreceptor drum 54, the charging unit 55 and the cleaning unit 59 are integrated as a process cartridge. In an alternative configuration, the similar, if not the same, effect may be achieved. Furthermore, when the imaging portion is integrated as a process cartridge, the maintenance of the imaging portion may be easily performed.

According to the first exemplary embodiment, the present invention, is applied to the developing unit used in a monochrome image forming apparatus.

However, the present invention, in another embodiment, is applied to a plurality of developing units in a color image forming apparatus.

Furthermore, the present invention, in another embodiment, is applied to the developer using the two-component developer composed of toner and carriers.

In another embodiment, the present invention is applied to a developing unit using a single component developer.

Figure 7:
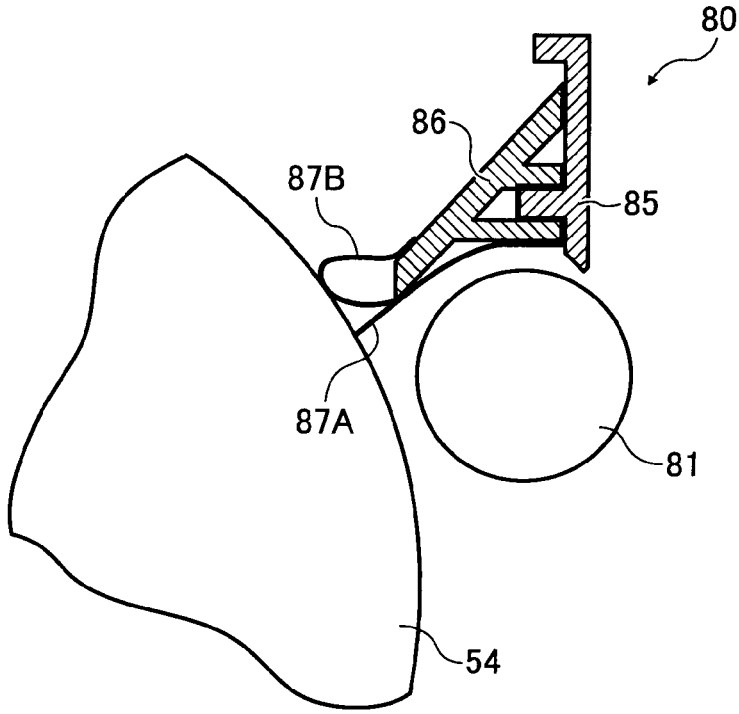
FIG. 7 is an enlarged view of a portion of a developing unit according to a second exemplary embodiment of the present invention.

Referring now to FIG. 7, a description is given of a second exemplary embodiment of the present invention.

FIG. 7 is an enlarged view illustrating a portion of the developing unit according to the second exemplary embodiment. According to the second exemplary embodiment, the structures of the inlet sealing, the holder holding the inlet sealing, and the doctor blade in the developing unit are different from the first exemplary embodiment.

As shown in FIG. 7, according to the second exemplary embodiment, the inlet sealing, serving as a sealing member, includes a first inlet sealing 87A and a second inlet sealing 87B. The first inlet sealing 87A adheres to an opposing surface of the holder 86. The second inlet sealing 87B has a substantially pouched structure and is adhered to a tip portion of the holder 86.

The second inlet sealing 87B includes a U-shape curved portion and is disposed such that the curved portion abuts the photoreceptor drum 54. This structure allows the curved portion of the second inlet sealing 87B to come into contact with the photoreceptor drum 54. Accordingly, the contact area of the second inlet sealing 87B with the photoreceptor drum 54 increases. Furthermore, according to the second exemplary embodiment, the contact portions of the doctor blade 85 and the holder 86 is formed in a manner such that both contact portions are engaged with each other. Accordingly, the closeness between the doctor blade 85 and the holder 86 increases so that the air may be prevented from flowing into the region H shown in FIG. 4.

The region H herein refers to an area from the second opposing position to the contact position. The second opposing position refers to a position where the doctor blade 85 faces the first developing roller 81. The contact position refers to the position where the inlet sealings 87A and 87B abut the photoreceptor drum 54.

As described above, similar to the first exemplary embodiment, an increase in the internal pressure of the developing unit 80 may be effectively reduced with a relatively simple structure. Furthermore, the problem of the developer scattering out of the developing unit 80 may be adequately suppressed.

Figure 8:
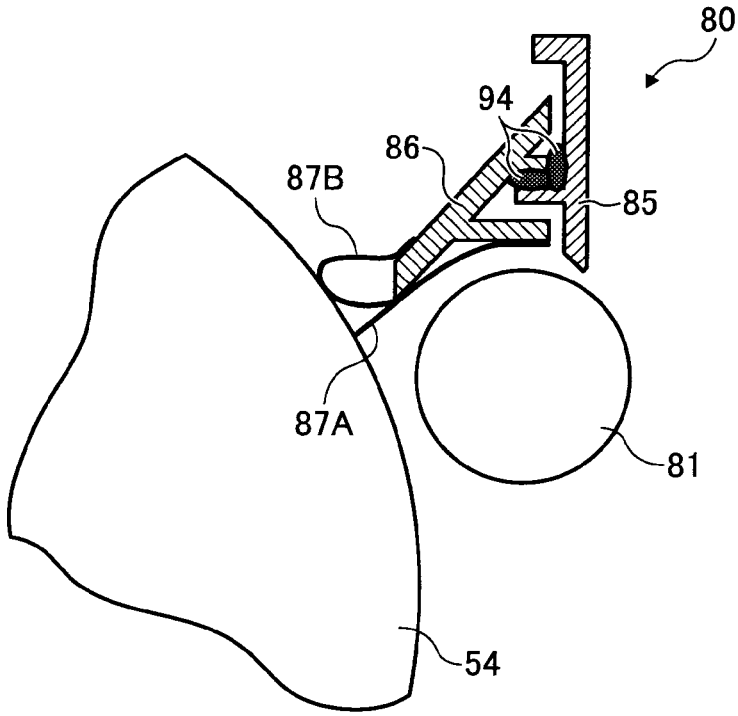
FIG. 8 is an enlarged view of a portion of a developing unit according to a third exemplary embodiment of the present invention.

Referring now to FIG. 8, an enlarged view of a portion of the developing unit according to a third exemplary embodiment is shown. According to the third exemplary embodiment, the structures of the holder which holds the inlet sealing and the doctor blade are different from the first and second exemplary embodiments.

As shown in FIG. 8, according to the third exemplary embodiment, the holder 86 is fitted with the doctor blade 85 through an adhesive 94 serving as an adhesive member.

The adhesive 94 is thoroughly applied to the contact surfaces of the doctor blade 85 and the holder 86. Therefore, both the doctor blade 85 and the holder 86 are assembled through this configuration. The adhesive 94 is formed of epoxy adhesive material or any other desired adhesive material, for example.

This configuration enhances the closeness between the doctor blade 85 and the holder 86. Accordingly, the air may be prevented from flowing into the region H shown in FIG. 4.

The region H herein refers to an area from the second opposing position to the contact position. The second opposing position refers to a position where the doctor blade 85 faces the first developing roller 81. The contact position refers to the position where the inlet sealings 87A and 87B abut the photoreceptor drum 54.

According to the third exemplary embodiment, the adhesive 94 is used as an adhesive member between the holder 86 and the doctor blade 85. In an alternative embodiment, a double-sided tape is used as an adhesive member.

As described above, similar to the first and second exemplary embodiments, an increase in the internal pressure of the developing unit 80 may be effectively reduced with this configuration. Furthermore, the problem of the developer scattering out of the developing unit 80 may be suppressed.

Figure 9:
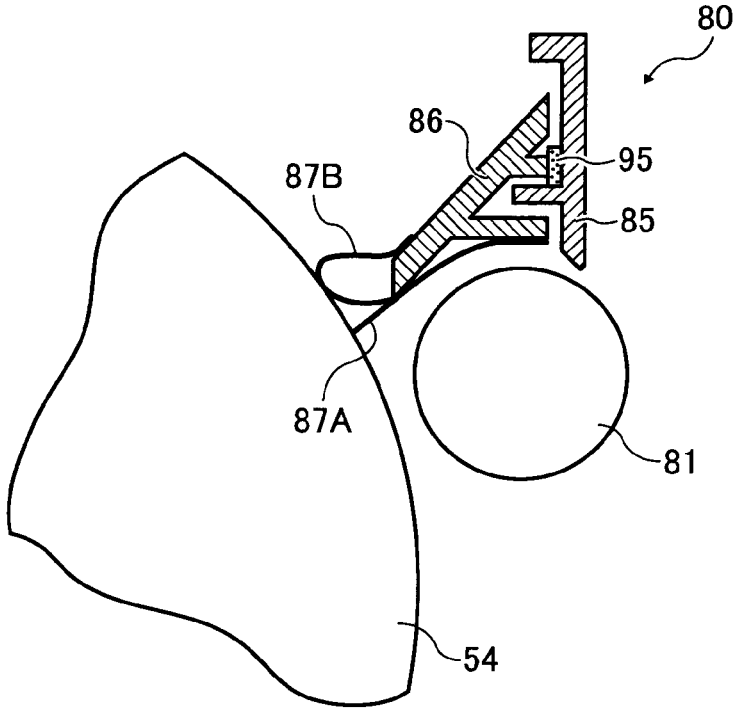
FIG. 9 is an enlarged view of a portion of a developing unit according to a fourth exemplary embodiment of the present invention.

Referring now to FIG. 9, an enlarged view of a portion of the developing unit according to a fourth exemplary embodiment is shown.

According to the fourth exemplary embodiment, the structures of the holder holding the inlet sealing and the doctor blade are different from the other exemplary embodiments described above.

As shown in FIG. 9, according to the fourth exemplary embodiment, the holder 86 is in close contact with the doctor blade 85 through an elastic member 95. The elastic member 95 is formed of an urethane foam, or any other desired material, and is provided between the contact surfaces of the doctor blade 85 and the holder 86.

The doctor blade 85 and the holder 86 are assembled so that both contact surfaces of the doctor blade 85 and the holder 86 press the elastic member or the urethane foam 95 to a moderate degree.

This configuration enhances the closeness between the doctor blade 85 and the holder 86. Accordingly, the air may be prevented from flowing into the region H shown in FIG. 4.

The region H herein refers to an area from the second opposing position to the contact position. The second opposing position refers to a position where the doctor blade 85 faces the first developing roller 81. The contact position refers to the position where the inlet sealings 87A and 87B abut the photoreceptor drum 54.

The elastic member or the urethane foam 95 is adhered to either the doctor blade 85 or the holder 86 by a double-sided tape, thereby making it easy to disassemble the doctor blade 85 and the holder 86, and thus, easy to recycle both of these pieces.

In one embodiment, for the material of the urethane foam 95, a urethane foam of a single-bubble type in which bubbles or pores are independently formed is preferred over a continuous-bubble type urethane foam. With this configuration, it is possible to prevent the air from flowing into the developing unit 80.

According to the fourth exemplary embodiment, the urethane foam is used as an elastic member disposed between the holder 86 and the doctor blade 85.

A rubber foam is used as the elastic member. The rubber foam provides less air circulation and less deterioration over time.

As described above, according to the fourth exemplary embodiment, an increase in the internal pressure of the developing unit 80 may be effectively reduced with this configuration. Furthermore, the problem of the developer scattering out of the developing unit 80 may be adequately suppressed.

Figure 10:
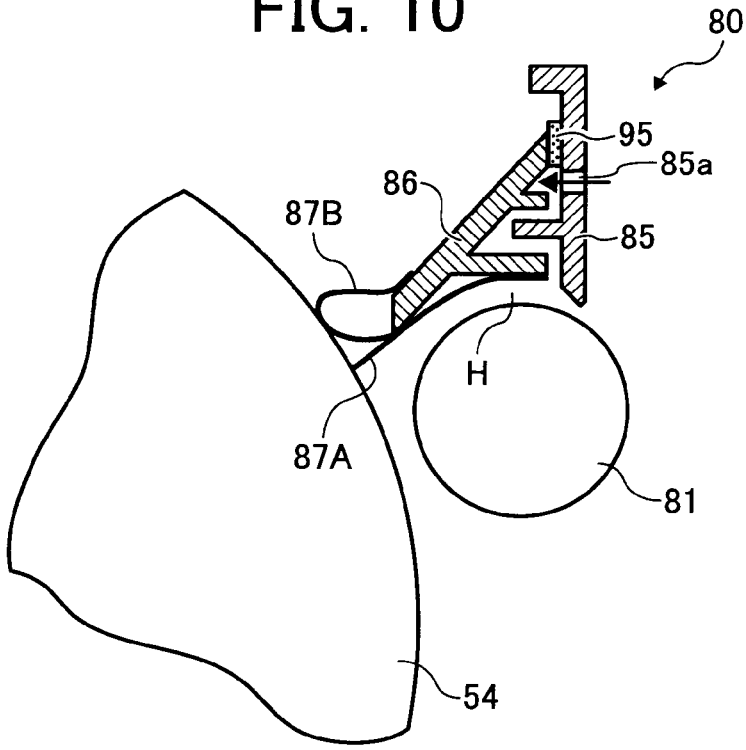
FIG. 10 is an enlarged view of a portion of a developing unit according to a fifth exemplary embodiment of the present invention.
Figure 11:
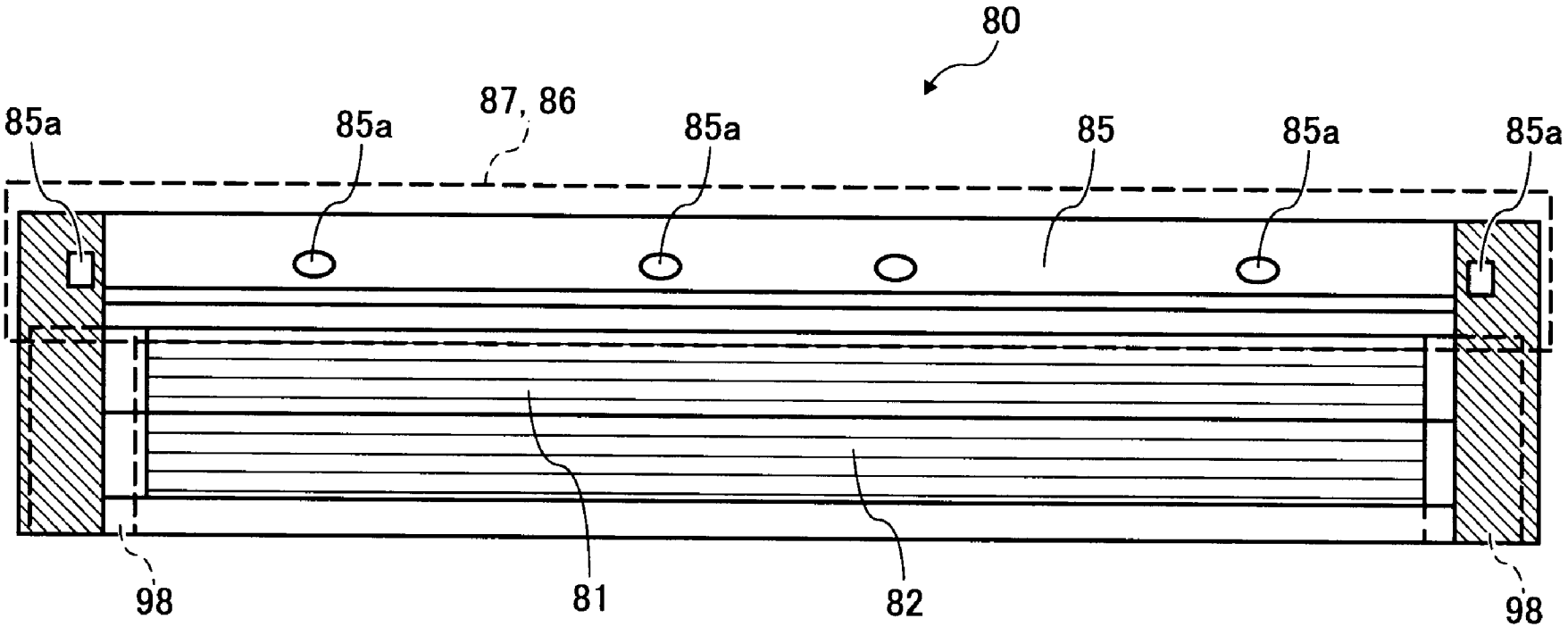
FIG. 11 is a schematic diagram illustrating the developing unit of FIG. 10 seen along a longitudinal direction.

Referring now to FIGS. 10 and 11, a description is given of a fifth exemplary embodiment.

FIG. 10 is an enlarged view of a portion of the developing unit according to the fifth exemplary embodiment. FIG. 11 is a schematic diagram of the developing unit of FIG. 10 seen in the longitudinal direction.

According to the fifth exemplary embodiment, the structures of the holder holding the inlet sealing and the doctor blade are different from the other exemplary embodiments described above.

As shown in FIG. 10, similar to the fourth exemplary embodiment, the elastic member 95 is provided between the contact surfaces of the doctor blade 85 and the holder 86 according to the fifth exemplary embodiment. The doctor blade 85 and the holder 86 are assembled so that both contact surfaces of the doctor blade 85 and the holder 86 press the elastic member or the urethane foam 95 to a moderate degree.

This configuration enhances the closeness between the doctor blade 85 and the holder 86. Accordingly, the air may be prevented from flowing into the region H shown in FIG. 10.

The region H herein refers to an area from the second opposing position to the contact position. The second opposing position refers to a position where the doctor blade 85 faces the first developing roller 81. The contact position refers to the position where the inlet sealings 87A and 87B abut the photoreceptor drum 54.

Furthermore, according to the fifth exemplary embodiment, a vent path communicates from the inside of the developing unit 80 to the region H, which is the area from the second opposing position to the contact position.

With reference to FIGS. 10 and 11, a plurality of air vent holes 85*a* are provided on the doctor blade 85 along the longitudinal direction thereof. The air vent holes are at positions where the holes are not covered by the developer. Furthermore, at both ends of the doctor blade 85, which is the area corresponding to the position where an end sealing 98 is closely in contact with the inlet sealing 87, the air vent holes 85*a* are provided. At the center of the doctor blade 85, four air vent holes 85*a* are provided in a substantially equally spaced manner. Therefore, the air shown by an arrow in FIG. 10 flowing into the developing unit 80 through the air vent holes 85*a* travels through the space (the vent path) between the doctor blade 85 and the holder 86 to the region H at a negative pressure as described above.

Accordingly, the level of the negative pressure of the region H may be reduced or come close to a zero pressure due to traveling of the air in the developing unit 80. Thus, toner ejection or scattering to the outside of the developing unit 80 may be reduced.

According to the fifth exemplary embodiment, the air vent holes 85*a* are provided at both ends and at the center of the doctor blade 85. However, in another embodiment, the air vent holes 85*a* are provided to an area where the toner is most likely to scatter in the developing unit 80. For example, when the toner is most likely to scatter at both ends of the developing unit 80 instead of at the central area thereof, the air vent holes 85*a* are provided to only both ends of the doctor blade 85.

As described above, according to the fifth exemplary embodiment, an increase in the internal pressure of the developing unit 80 may be effectively reduced with this configuration. Furthermore, the problem of the developer scattering out of the developing unit 80 may be adequately suppressed.

Further, elements and/or features of different exemplary embodiments may be combined with each other and/or substituted for each other within the scope of this disclosure and appended claims.

In other embodiments, any one of the above-described and other exemplary features of the present invention are embodied in the form of an apparatus, method, system, computer program and computer program product. For example, the aforementioned methods are embodied in the form of a system or device, including, but not limited to, any of the structure for performing the methodology illustrated in the drawings.

One or more embodiments of the present invention are implemented using a conventional general purpose digital computer programmed according to the teachings of the present specification, as is apparent to those skilled in the computer art.

Appropriate software coding can readily be prepared by skilled programmers based on the teachings of the present disclosure, as is apparent to those skilled in the software art.

One or more embodiments of the present invention is implemented by the preparation of application specific integrated circuits or by interconnecting an appropriate network of conventional component circuits, as is readily apparent to those skilled in the art.

Any of the aforementioned methods may be embodied in the form of a system or device, including, but not limited to, any of the structure for performing the methodology illustrated in the drawings.

Furthermore, any of the aforementioned methods is embodied in the form of a program. The program is stored on a computer readable media and is adapted to perform any one of the aforementioned methods when running on a computer device (a device including a processor). Thus, the storage medium or computer readable medium, is adapted to store information and is adapted to interact with a data processing facility or computer device to perform the method of any of the above mentioned embodiments.

In one embodiment, the storage medium is a built-in medium installed inside a computer device main body or a removable medium arranged to be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited not limited to any of the structure for performing the methodology illustrated in the drawings.

The invention claimed is:

1. A developing unit for developing a latent image formed on an image carrier, the developing unit comprising:

a developer carrier configured to bear a developer and facing the image carrier at a first position;

a developer regulator configured to regulate an amount of the developer, the developer regulator disposed facing the developer carrier at a second position upstream of the developer carrier in a moving direction thereof relative to the first position; and a sealing member configured to come into contact with the image carrier at a third position upstream of the image carrier in a moving direction thereof relative to the first position, wherein gas is prevented from flowing from an outside area of the developing unit into an area defined by the second position to the third position, and wherein the developer regulator includes a substantially vertical wall, the wall having a vent hole disposed substantially horizontally through the wall such that the developer on the developer carrier does not cover the vent hole and air travels from an inside of the developing unit through the developer regulator and exits proximate to an upper surface of the developer carrier.

2. The developing unit according to claim 1, further comprising:

a holder configured to hold the sealing member and tightly attached to the developer regulator.

3. The developing unit according to claim 2, wherein the holder is tightly attached to the developer regulator through an adhesive member.

4. The developing unit according to claim 3, wherein the adhesive member is a double-faced tape or an adhesive material.

5. The developing unit according to claim 2, wherein the holder is tightly attached to the developer regulator through an elastic material.

6. The developing unit according to claim 5, wherein the elastic material is a urethane foam or a foamed rubber.

7. The developing unit according to claim 2, wherein the holder is integrally formed with the developer regulator.

8. The developing unit according to claim 2, wherein the wall of the developer regulator includes at least one substantially horizontal extension extending in a first direction toward the holder, and the holder includes at least one substantially horizontal extension extending in a second direction toward the wall, the extensions being spaced apart such that the air travels between the extensions.

9. The developing unit according to claim 2, wherein an upper end of the holder is adjoined at a junction to the wall of the developer regulator and the at least one vent hole is disposed through the wall below the junction.

10. The developing unit according to claim 9, wherein the sealing member is a first sealing member and wherein the developing unit further comprises a second sealing member attached to a lower end of the holder, the second sealing member being substantially U-shaped and contacting the image carrier at a position upstream from the first sealing member.

11. The developing unit according to claim 1, wherein the sealing member is integrally formed with the developer regulator.

12. The developing unit according to claim 1, wherein the sealing member comprises:

a U-shaped curve in contact with the image carrier.

13. The developing unit according to claim 1, wherein the developer comprises:

a toner, a carrier, and satisfies the following relationship:

$$3 \leqq Dv \leqq 8, \text{ and}$$

$$1.00 \leqq Dv/Dn \leqq 1.40,$$

wherein Dv (μm) is a volume-average particle diameter of the toner, and Dn (μm) is a number average particle diameter.

14. The developing unit according to claim 13, wherein the toner has a shape factor (SF-1) in a range between 100 and 180, and a shape factor (SF-2) in a range between 100 and 180.

15. The developing unit according to claim 1, wherein a plurality of vent holes are disposed substantially equidistant from each other along the wall in a longitudinal direction.

16. The developing unit according to claim 1, wherein a plurality of vent holes are disposed substantially in a center of the wall with respect to a longitudinal direction.

17. The developing unit according to claim 1, wherein a plurality of vent holes are disposed on opposing ends of the wall with respect to a longitudinal direction.

18. A process cartridge detachable relative to an image forming apparatus, comprising:

an image carrier;

at least one charging unit configured to charge the image carrier;

a cleaning unit configured to clean the image carrier; and a developing unit configured to develop a latent image formed on an image carrier, the developing unit including a developer carrier configured to bear a developer and facing the image carrier at a first position, a developer regulator configured to regulate an amount of the developer, the developer regulator disposed facing the developer carrier at a second position upstream of the developer carrier in a moving direction thereof relative to the first position, and a sealing member configured to come into contact with the image carrier at a third position upstream of the image carrier in a moving direction thereof relative to the first position, wherein gas is prevented from flowing from an outside area of the developing unit into an area defined by the second position to the third position, and wherein the developer regulator includes a substantially vertical wall, the wall having a vent hole disposed substantially horizontally through the wall such that the developer on the developer carrier does not cover the vent hole and air travels from an inside of the developing unit through the developer regulator and exits proximate to an upper surface of the developer carrier.

19. An image forming apparatus, comprising:

an image carrier;

a charging unit configured to charge the image carrier;

an exposure unit configured to irradiate the image carrier with an exposure light to form a latent image thereon;

a developing unit configured to develop the latent image with a developer having toner to form a toner image, on the image carrier;

a transfer unit configured to transfer the toner image onto a transfer sheet; and a fixing unit configured to fix the toner image on the transfer sheet, wherein the developing unit includes a developer carrier configured to bear a developer and facing the image carrier at a first position, a developer regulator configured to regulate an amount of the developer, the developer regulator disposed facing the developer carrier at a second position upstream of the developer carrier in a moving direction thereof relative to the first position, and a sealing member configured to come into contact with the image carrier at a third position upstream of the image carrier in a moving direction thereof relative to the first position, wherein gas is prevented from flowing from an outside area of the developing unit into an area defined by the second position to the third position, and wherein the developer regulator includes a substantially vertical wall, the wall having at least one vent hole disposed substantially horizontally through the wall such that the developer on the developer carrier does not cover the at least one vent hole and air travels from an inside of the developing unit through the developer regulator and exits proximate to an upper surface of the developer carrier.

* * * * *